United States Patent [19]

Yamada et al.

[11] Patent Number: 4,464,069

[45] Date of Patent: Aug. 7, 1984

[54] PRINTING APPARATUS DISPLAY DEVICE FOR SIMULTANEOUSLY DISPLAYING COMPLETE WORDS

[75] Inventors: Yasuaki Yamada, Matsudo; Toshiaki Ozawa, Higashi; Hiroatsu Kondo, Zushi, all of Japan

[73] Assignee: Canon Kabushiki Kaisha, Tokyo, Japan

[21] Appl. No.: 501,753

[22] Filed: Jun. 10, 1983

Related U.S. Application Data

[63] Continuation of Ser. No. 241,427, Mar. 6, 1981, abandoned.

[30] Foreign Application Priority Data

Mar. 17, 1980 [JP] Japan ..... 55-32791

[51] Int. Cl.[3] ..... B41J 29/42

[52] U.S. Cl. ..... 400/83; 400/3

[58] Field of Search ..... 400/3, 83; 340/711

[56] References Cited

U.S. PATENT DOCUMENTS 3,757,921 9/1973 Bishop ..... 400/3
4,223,393 9/1980 Abe et al. ..... 400/83 X

FOREIGN PATENT DOCUMENTS 2621146 11/1977 Fed. Rep. of Germany ..... 400/83
2806121 7/1979 Fed. Rep. of Germany ..... 400/83
65577 5/1980 Japan ..... 400/83
2044969 10/1980 United Kingdom ..... 400/83

OTHER PUBLICATIONS

IBM Technical Disclosure Bulletin, "Temporary Display for Word Processing System", Kolpek et al., vol. 19, No. 2, Jul. 1976, pp. 564–565.

*Primary Examiner*—Ernest T. Wright, Jr.
*Attorney, Agent, or Firm*—Fitzpatrick, Cella, Harper & Scinto

[57] ABSTRACT

A display device is capable of showing an entire sentence stored in a memory with a limited number of key operations and without interruption of the spelling of each word. The display device is provided with a memory for storing a sentence composed of plural word groups, readout means for reading the sentence from the memory, a display unit for displaying the sentence read from the memory, and an identifying unit for identifying the spaces in the sentence, wherein the sentence after a space identified by the identifying unit is supplied to the display unit.

8 Claims, 13 Drawing Figures

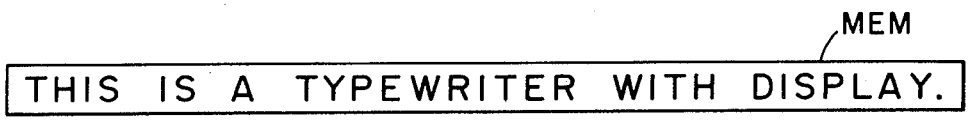
FIG. 2
FIG. 3
PRIOR ART
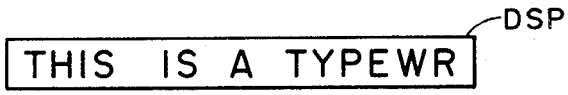
FIG. 4
PRIOR ART
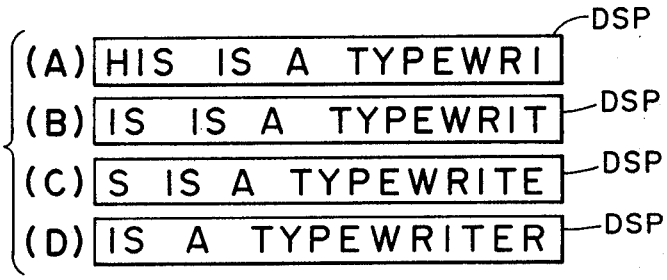
FIG. 5
PRIOR ART
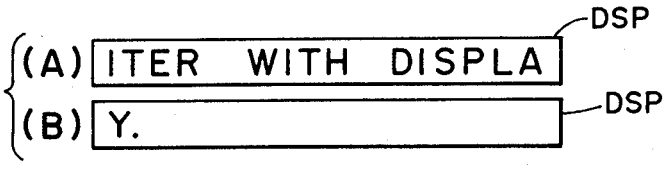
FIG. 8
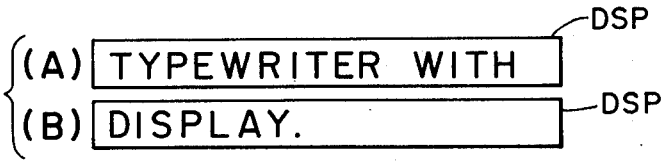

PRINTING APPARATUS DISPLAY DEVICE FOR SIMULTANEOUSLY DISPLAYING COMPLETE WORDS

This application is a continuation of application Ser. No. 241,427 filed Mar. 6, 1981, now abandoned.

BACKGROUND OF THE INVENTION

1. Field of the Invention

The present invention relates to a display device for use in a typewriter or the like having an oblong display unit capable of displaying a part of one line to be typewritten.

2. Description of the Prior Art

Such an electronic typewriter with a conventional display device generally has a display capacity of several tens of characters at maximum despite the fact that it can type more than one hundred characters in a line. Thus, in case a sentence stored in an auxiliary memory inside or outside the typewriter need be displayed for confirmation before actual typing, the operator can see only a part of said sentence and has to conduct a character-by-character shifting of the display for confirming the entire sentence.

As an example, FIG. 1 shows a conventional typewriter of this type, provided with a memory MEM that may be for example a semiconductor memory, a key K1 in the keyboard for KB for reading a sentence stored in said memory MEM and eventually in an external memory, an oblong display unit DSP for displaying a part of said sentence thus read, and a shift key K2 for shifting the sentence displayed on said display unit DSP. The above-explained typewriter functions in the following manner when, as an example, the memory MEM stores a sentence as shown in FIG. 2, composed of 34 characters including spaces and punctuation marks. In case of a display capacity of 16 digits, the sentence read from the memory MEM under the instruction by the key K1 is displayed on the display unit DSP as shown in FIG. 3. Then, in response to each actuation of the shift key K2, the displayed content is shifted to the left by one character, in the order as shown in FIGS. 4A to 4D. Consequently the shift key K2 has to be repeatedly actuated for seeing the entire sentence in case it is long. In order to prevent such inconvenience the above-mentioned shift key K2 can be replaced by a line-shift key similar to the page-shift key known in CRT display devices. In such case, in response to the actuation of the line-shift key, the characters displayed as shown in FIG. 3 are entirely changed to as shown in FIG. 5A, and then as shown in FIG. 5B in response to the repeated actuation of said line-shift key. Although such structure reduces the cumbersomeness of key operations, the display on the display unit DSP often causes the words to be split as shown in FIGS. 5A and 5B, affecting the legibility of the displayed sentence and rendering erros in spelling less easily discoverable.

SUMMARY OF THE INVENTION

The object of the present invention is to provide a display device allowing the display of an entire sentence with a limited number of key operations and without interruption within a word.

Another object of the present invention is to provide a display device comprising memory means for storing a sentence composed of plural character groups, readout means for reading a sentence from said memory means, display means for visual display of the sentence read by said readout means, identifying means for identifying space or punctuation marks in said sentence, and means for supplying to said display means a sentence after a space or a punctuation mark identified by said identifying means.

Still another object of the present invention is to provide a display device comprising memory means for storing a sentence composed of plural character groups, display means for displaying a certain number of digits of the sentence stored in said memory means, a code register memory storing space/punctuation codes indicating the space or punctuation marks in the sentence stored in said memory means, comparator means for identifying whether the last character code of the sentence displayed on said display means coincides with one said codes stored in said code register memory, search means for searching a nearest space/punctuation code to the end of the displayed sentence in case said comparator means indicates the absence of coincidence, and display instructing means for causing the display means to display a sentence following the nearest space/punctuation code detected by said search means.

Still another object of the present invention is to provide a display device comprising memory means for storing a sentence composed of plural character groups, display means for displaying the sentence stored in said memory means, identifying means for identifying space or punctuation marks in said sentence, and instruction means for searching a nearest space or punctuation mark to the end of the displayed sentence and causing the display of a sentence following such nearest space or punctuation mark in case said identifying means identifies that the end of the displayed sentence is not a space and not a punctuation mark, and causing the display of a sentence following the displayed sentence in case such space or punctuation mark is not present.

BRIEF DESCRIPTION OF THE DRAWING

FIG. 2 is a schematic view showing an example of the sentence stored in the memory thereof;

FIG. 3 is a schematic view showing an example of the display of the sentence stored in the typewriter shown in FIG. 1;

FIGS. 4A to 4D are schematic views showing the examples of displays obtained by leftward character shift in the typewriter shown in FIG. 1;

FIGS. 5A and 5B are schematic views showing an example of a conventional display device in which the displayed sentence is entirely renewed;

FIGS. 8A and 8B are schematic views showing an example of the display obtained by the display device of the present invention.

DESCRIPTION OF THE PREFERRED EMBODIMENTS

Now the present invention will be clarified in detail by the following description to be taken in conjunction with the attached drawing. The display device of the present invention will hereafter be explained by an application thereof in an electronic typewriter, which is however identical with that shown in FIG. 1, except that the aforementioned key K2 is replaced by a key K3.

Figure 6:
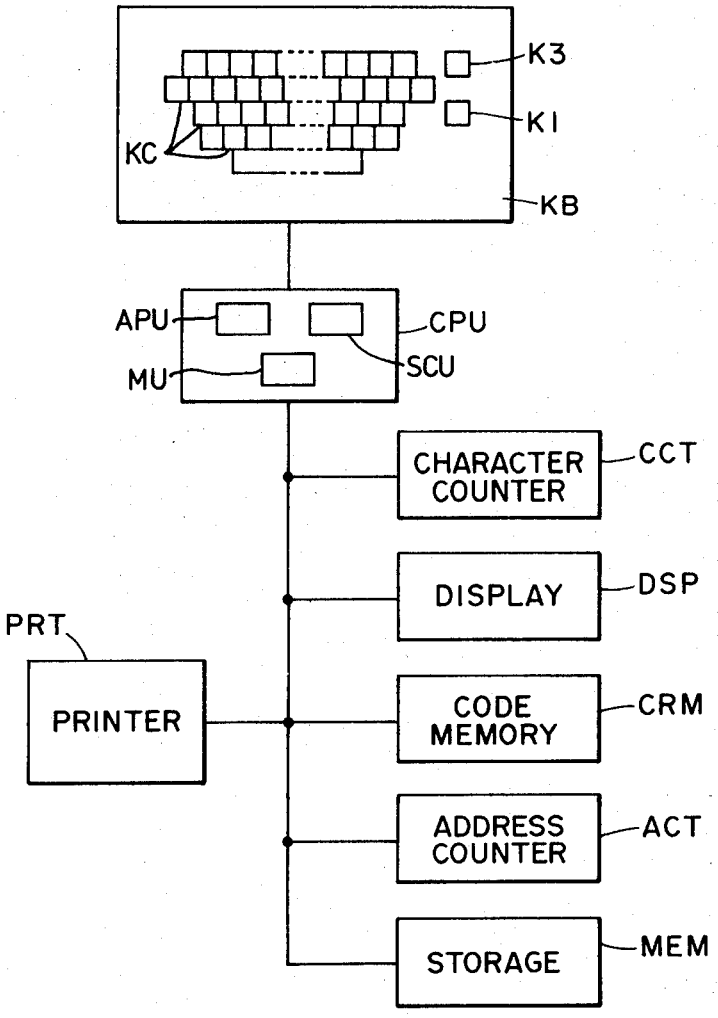
FIG. 6 is a block diagram showing an example of the the structure of the electronic typewriter employing a display device of the present invention.
Figure 7:
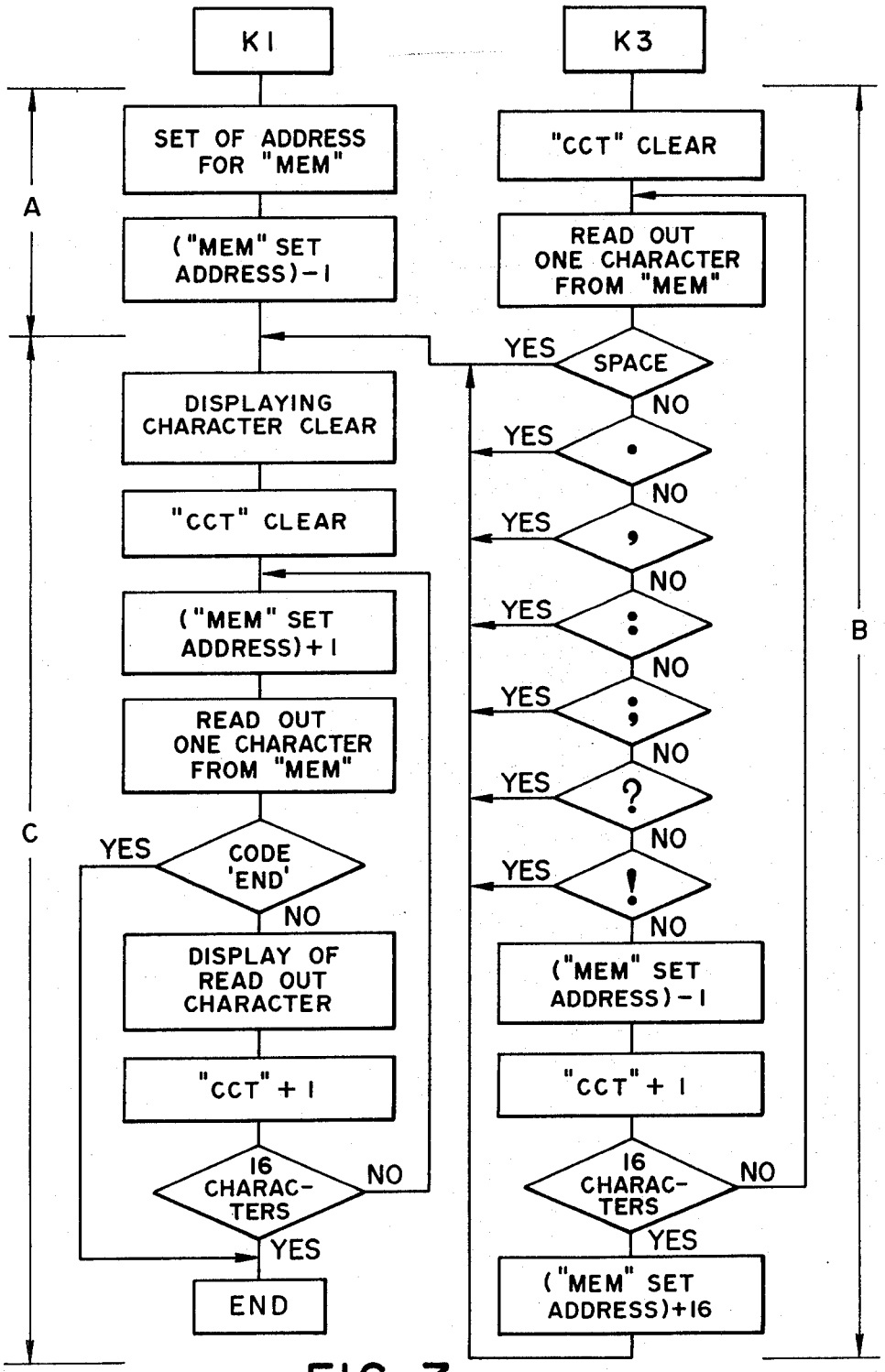
FIG. 7 is a flow chart of the function of the electronic typewriter provided with the display device of the present invention as shown in FIG. 6.

FIG. 6 shows an example of the circuit structure of an electronic typewriter employing the display device of the present invention, while FIG. 7 shows a flow chart for the display process according to the present invention, and FIGS. 8A and 8B show an example of the display obtainable according to the present invention.

Figure 1:
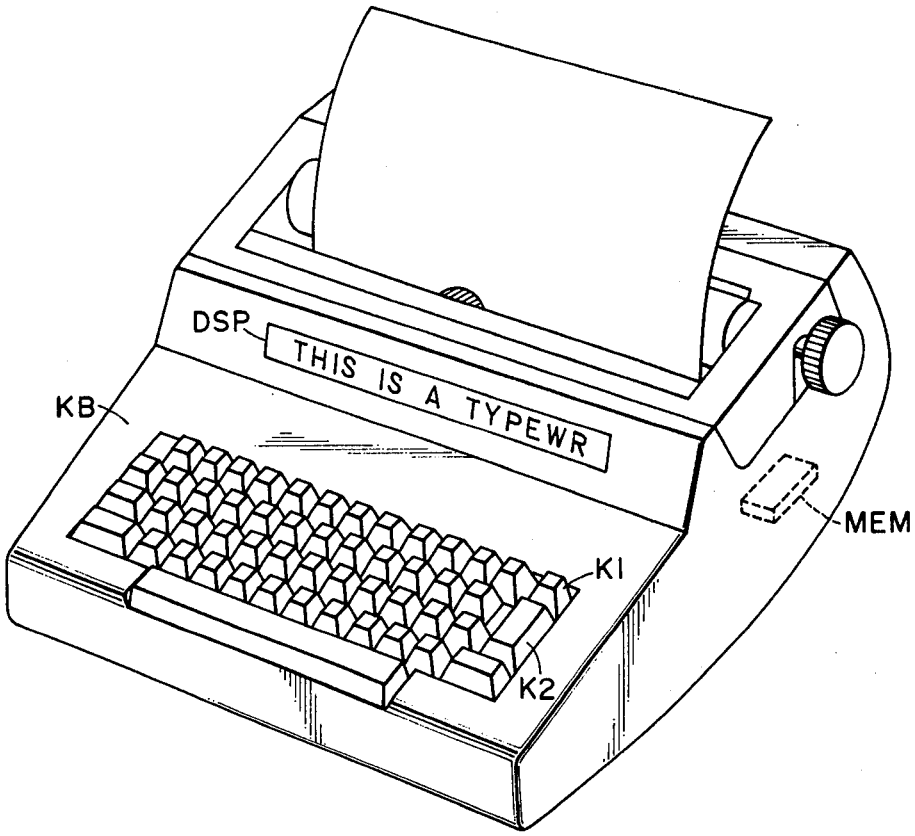
FIG. 1 PRIOR ART
FIG. 1 is an external view of an electronic typewriter having a conventional display device.

In FIG. 6 there are shown a shift key K3 for causing a shift in the displayed content without interruption within a word, said shift key K3 being positioned in the keyboard KB in place of the shift key K2 shown in FIG. 1; a central processing unit CPU having a arithmetic process unit APU, a memory unit MU storing a control program and a sequence control unit SCU for controlling the flow of said control program; a character counter CCT for counting the number of characters displayed on a display unit DSP; a code register memory CRM storing the codes for space, period (.), comma (,), colon (:), semi-colon (;), question mark (?), exclamation mark (!) etc,; a memory address counter ACT for determining the address of memory readout; and a printer PRT. The memory MEM and display unit DSP are similar to those shown in FIG. 1.

In the circuit shown in FIG. 6, the characters, as they are entered by character input keys KC, are stored in said memory MEM and simultaneously displayed on the display unit DSP. Each character enter after the display on the display unit DSP has reached the maximum capacity thereof is displayed at the right-end place after the existing display is shifted by one place to the left. In such structure, in response to the actuation of the memory readout key K1 in the keyboard KB, the operation sequence is initiated according to the sections A and C of the flow chart shown in FIG. 7, whereby the memory address counter ACT is set to the first address of the memory MEM for data readout, and the characters are read in succession from the memory MEM and displayed on the display unit DSP until the character counter CCT reaches the maximum displayable number of characters of said display unit DSP, for example 16 in this case. Then in response to the actuation of the shift key K3 the operation sequence enters the section B of the flow chart shown in FIG. 7, whereby the character counter CCT is cleared, and a character code corresponding to the memory readout address set in the memory address counter ACT is read from the memory MEM. Said character is the last one of the characters already displayed, and is "R" in case of the example shown in FIG. 3. The central processing unit CPU compares said character code with the codes stored in the code register memory CRM, starting from the "space" code, "period" code to the "exclamation mark" code. In case of the character "R" shown in FIG. 3, these comparisons do not result in coincidence, so that the sequence goes through all the identification blocks whereby the readout address of the memory MEM is step decreased and the content of the character counter CCT is step increased.

In case the content of said counter CCT is less than 16, the program returns to the step of reading a character from the memory MEM and thereafter making comparisons with the codes stored in the code register memory CRM, starting from the "space" code through the "period" code to the "exclamation mark" code, whereby, in the example shown in FIG. 3, a character "W" preceding "R" is read from the memory MEM. The space between "A" and "TYPEWRITER" is identified by the repetition of the above-explained procedure, whereupon the program proceeds to the section C of the flow chart. The counting by the character counter CCT of the above-mentioned loops in the section B is conducted in order to terminate said loop process in case a word is composed of more than 16 characters, whereby the word is displayed in incomplete fashion, and the remaining part of said word and the succeeding sentence are displayed upon actuation again of the key K3.

In the section C of the flow chart the character codes are read from the memory MEM and displayed on the display unit DSP until a memory end code END is read from the memory MEM or until 16 character codes are read from the memory MEM whereby the display procedure is completed.

More particularly, in the section C of the flow chart, the characters displayed on the display unit DSP are at first erased and the character counter CCT is cleared to prepare for the new display. Subsequently the memory readout address indicated by the address counter ACT is step increased to read a character of the corresponding address from the memory MEM. In the example shown in FIG. 3, since the space between "A" and "TYPEWRITER" was previously detected in the section B of the flow chart, there are read at first "T" of "TYPEWRITER", then "Y", "P", "E", "W", "R", "I", "T", "E", "R", "space", "W", "I", "T", "H", and "space", thus 16 characters in total are read from the memory MEM, whereby a display as shown in FIG. 8A is obtained on the display unit DSP to complete the display procedure. Upon reactuation of the shift key K3 a word "DISPLAY" is displayed in a similar manner. In this case the memory end code END is read from the memory MEM before the readout of 16 characters, thereby terminating the memory readout and providing a display as shown in FIG. 8B.

As explained in the foregoing, the present invention provides the display of a sentence within the maximum capacity of the display device without interruption within a word in response to the actuation of a shift key K3, whereby the display DSP is rendered easily legible and allows easy confirmation and correction of the words or sentence entered into the apparatus.

What we claim is:

1. A display device, comprising:

memory means for storing a sentence comprising plural groups of characters separated by spaces or punctuation marks;

readout means for reading the sentence from said memory means;

display means having a first end and a second end defining therebetween a limited number of places for displaying at least a portion of the sentence read by said readout means;

identifying means for identifying in a portion of a sentence initially displayed by said display means, the one of the spaces and of the punctuation marks located directly before one of said plural groups of characters comprising said sentence that is interrupted by said second end of said display means, irrespective of the length of said one of said plural groups of characters; and applying means for subsequently supplying to said display means from said memory means another portion of the sentence beginning with said one of said plural groups of characters which was initially interrupted by said second end of said display means and following the one of said spaces and punctuation marks identified by said identifying means, whereby at least said one of said plural groups of characters is displayed in its entirety provided said one of said plural groups of characters it does not comprise a number of characters greater than said limited number.

2. A display device according to the claim 1, wherein said readout means comprises a memory address counter for determining the reading address of a sentence to be read from said memory means, and a character counter for counting the characters to be read from said memory means and displayed on said display means.

3. A display device according to the claim 1, further comprising instructing means for instructing replacement of a display on said display means with a new display and, wherein said identifying means searches for said one of said spaces and said punctuation marks in response to an instruction by said instructing means.

4. A display device according to the claim 3, wherein said instructing means comprises a shift key.

5. A display device, comprising:

memory means for storing a sentence comprising plural groups of characters separated by spaces or punctuation marks, each of said characters, spaces and punctuation marks being represented by a character code;

display means having a first end and a second end defining therebetween a limited number of places for displaying at least a portion of the sentence stored in said memory means;

a code register memory for storing, in advance, fixed space/punctuation codes for comparison with spaces and punctuation marks in a sentence;

comparator means for identifying whether the last character code of the portion of a sentence initially displayed on said display means coincides with any of the fixed space/punctuation codes stored in said code register memory;

search means for finding the space/punctuation code representing the one of the spaces and the punctuation marks located most closely to the end of the portion of the sentence initially displayed on said display means when identification by said comparator means shows absence of coincidence; and display instructing means for instructing subsequent display on said display means of another portion of the sentence beginning with the one of said plural groups of characters immediately following the space/punctuation code representing the one of the spaces and the punctuation marks found by said search mmeans, whereby at least said one of said plural groups of characters is displayed in its entirety provided said one of said plural groups of characters does not comprise a number of characters greater than said limited number.

6. A display device according to the claim 5, wherein said code register memory stores fixed space/punctuation codes indicating the spaces or punctuation marks such as period, comma, colon, semi-colon, question mark, exclamation mark and the like.

7. A display device, comprising:

memory means for storing a sentence comprising plural groups of characters separated by spaces or punctuation marks;

readout means for reading the sentence from said memory means;

display means having first and second ends defining therebetween a limited number of places for displaying at least a portion of a sentence read by said readout means;

a shift key for instructing shifting of a portion of a sentence displayed on said display means;

identifying means for identifying, upon actuation of said shift key, whether one of said plural groups of characters in a portion of a sentence initially displayed by said display means is interrupted by said second end of said display means; and control means for controlling said readout means so as to display on said display means another portion of the sentence beginning with said one of said plural groups of characters which was initially interrupted by said second end of said display means when said identifying means identifies that the one of the plural groups of characters was initially interrupted, whereby at least said one of the plural groups of characters is displayed in its entirety provided said one of the plural groups of characters does not comprise a number of characters greater than said limited number.

8. A display device, comprising:

memory means for storing a sentence comprising plural groups of characters separated by spaces or punctuation marks;

readout means for reading the sentence from said memory means;

display means having a first end and a second end defining therebetween a limited number of places, for displaying at least a portion of a sentence read by said readout means;

search means for finding in a portion of a sentence initially displayed on the display means, the one of the spaces and punctuation marks located directly before one of said plural groups of characters interrupted by the second end of said display means; and applying means for subsequently supplying to said display means another portion of the sentence beginning with said one of said plural groups of characters which was initially interrupted and following the one of the spaces and punctuation marks found by said search means, whereby at least said one of said plural groups of characters is displayed in its entirety provided said one of said plural groups of charaters it does not comprise a number of characters greater than said limited number.

* * * * *

UNITED STATES PATENT AND TRADEMARK OFFICE

CERTIFICATE OF CORRECTION

PATENT NO. : 4,464,069

DATED : August 7, 1984

INVENTOR(S) : YASUAKI YAMADA, ET AL.

It is certified that error appears in the above-identified patent and that said Letters Patent is hereby corrected as shown below:

Column 5, line 7, delete "it";

line 56, change "mmeans" to --means--.

Column 6, line 58, delete "it".

Signed and Sealed this

*Twenty-first* Day of *May 1985*

[SEAL]

*Attest:*

DONALD J. QUIGG

*Attesting Officer* *Acting Commissioner of Patents and Trademarks*